US005712071A

United States Patent [19]

Mikuriya et al.

[11] Patent Number: 5,712,071

[45] Date of Patent: Jan. 27, 1998

[54] TONER FOR DEVELOPING ELECTROSTATIC LATENT IMAGE

[75] Inventors: Yoshihiro Mikuriya, Amagasaki; Mikihiko Sukeno, Ashiya; Yoshikazu Nishihara, Itami; Hiroyuki Fukuda, Kobe, all of Japan

[73] Assignee: Minolta Co., Ltd., Osaka, Japan

[21] Appl. No.: 543,587

[22] Filed: Oct. 16, 1995

[30] Foreign Application Priority Data

Oct. 18, 1994 [JP] Japan ..... 6-251835

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,355,088 | 10/1982 | Westdale et al. | 430/98 |
| 4,386,147 | 5/1983 | Seimiya et al. | 430/99 |
| 4,486,524 | 12/1984 | Fujisaki et al. | 430/129 |
| 4,578,338 | 3/1986 | Gruber et al. | 430/120 |
| 4,604,338 | 8/1986 | Gruber et al. | 430/110 |
| 4,917,982 | 4/1990 | Tomono et al. | 430/99 |
| 4,939,060 | 7/1990 | Tomiyama et al. | 430/106.6 |
| 4,946,755 | 8/1990 | Inoue | 430/106.6 |
| 4,971,882 | 11/1990 | Jugle | 430/110 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,106,715 | 4/1992 | Matsumura et al. | 430/110 |
| 5,124,224 | 6/1992 | Burkes et al. | 430/110 |
| 5,171,653 | 12/1992 | Jugle et al. | 430/108 |
| 5,176,978 | 1/1993 | Kumashiro et al. | 430/110 |
| 5,278,018 | 1/1994 | Young | 430/106.6 |
| 5,292,609 | 3/1994 | Yoshkawa et al. | 430/110 |
| 5,466,555 | 11/1995 | Taguchi et al. | 430/110 |

*Primary Examiner*—Roland Martin

[57] ABSTRACT

A toner produced by pulverizing and classifying a melt and kneaded mixture comprising a binder resin, a colorant and an offset preventing agent, said binder resin comprising a styrene-type copolymer and said offset preventing agent comprising a polypropylene having a softening point of 135° to 155° C. and a polyethylene having a softening point of 100° to 150° C., wherein a total amount of said polypropylene and said polyethylene is 2 to 10 parts by weight per 100 parts by weight of the binder resin and a weight ratio of said polypropylene to said polyethylene is 1:3 to 1:1, and said pulverizing and classifying carried out by a pulverizer and classifier which impart mechanical impact on a particle to be treated.

35 Claims, 2 Drawing Sheets

TONER FOR DEVELOPING ELECTROSTATIC LATENT IMAGE

BACKGROUND OF THE INVENTION

1. Field of the Invention

The present invention relates to a toner for developing electrostatic latent images.

2. Description of the Related Art

Copy images produced by electrophotographic copying are obtained by performing an electrostatic latent image forming process by charging and optically exposing an electrostatic latent image-carrying member, developing process to develop the electrostatic latent image, and transfer process to transfer the toner image obtained by the developing process onto a copy sheet, and thereafter fixing the transferred toner image onto the copy sheet in a final process.

The fixing process is typically accomplished by methods wherein a heating roller is brought into direct pressure contact with the toner image (heat roll fixing method), or a heating member makes pressure contact with the toner image through a film (partial heat fixing method), and like methods. In these fixing methods, a part of the toner fused during fixing adheres to the fixing roller or film, so as to cause a so-called offset phenomenon when the toner is transferred onto the next copy sheet during a subsequent fixing process.

An example of the art of preventing offset phenomenon is disclosed in Japanese Laid-Open Patent Application No. SHO49-65231, which describes a toner comprising styrene-type resin and polypropylene wax as an offset preventing agent.

When, however, a copying sheet having an image produced by copying using the above-mentioned toner is used as an original document and placed in an automatic document feeder of a copying machine and copied, the copy image of the original document is rubbed by the sheet feeding roller of the document feeder, which causes marring and soiling of the image. In the case of duplex copies and multi-color copies, the copy image surface is rubbed by the sheet feeding roller during the second copy process, which also causes marring and soiling of the image. The same phenomenon occurs when a plurality of copy images are stacked and temporarily held in the copying machine as they are fed by the sheet feeding roller for the second copy, thereby reducing image quality. Toners having the above-mentioned disadvantages are called "poor smear resistance".

Deterioration of toner smear resistance can be prevented by using polyethylene wax instead of polypropylene wax as an offset preventing agent. Toners containing polyethylene wax have poor heat resistance, however.

On the other hand, toner is generally manufactured by melting and kneading the constituent materials, and thereafter pulverizing the melt and kneaded material by a pulverizer, and classifying the pulverized material by a classifying device. A jet pulverizer is used in the pulverization process to pulverize the particles via impact with an impact plate. An air classifying device is typically used in the classification process to classify the particles by size using an airflow.

Toner pulverized by the jet pulverizer and classified by an air classifying device has the disadvantage of having ultra fine toner powder mixed in, which leads to toner airborne dispersion and toner scattering and the like.

SUMMARY OF THE INVENTION

An object of the present invention is to provide a toner having excellent characteristics not previously obtained.

Another object of the invention is to provide a toner having excellent smear resistance characteristics.

A further object of the invention is to provide a toner having excellent offset resistance characteristics.

A still further object of the invention is to provide a toner which does not produce toner airborne dispersion nor scattering.

Another object of the invention is to provide a toner which does not cause image fog.

Another object of the invention is to provide a toner having excellent heat resistance.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
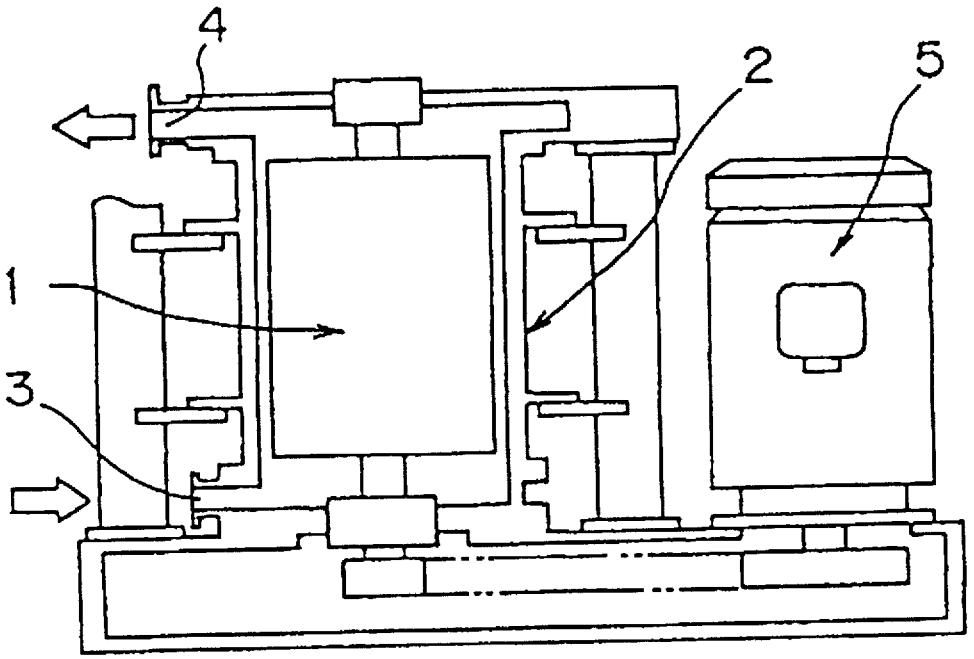
FIG. 1 briefly shows the construction of an example of an impact pulverizer using a high-speed airflow.

The toner of the present invention comprises at least a combination of binder resin having as its main constituent a styrene-type polymer, colorant, and specific offset preventing agent.

It is desirable that styrene-type copolymer is used as a styrene-type polymer. In the present invention, styrene-type copolymer means a polymer synthesized with a styrene-type monomer and a comonomer. A styrene-type monomer ratio of the styrene-type copolymer is at least 50 percent-by-weight, and preferably 60 percent-by-weight or more, and ideally 70 percent-by-weight or more on the basis of total monomers.

A styrene-type monomer ratio of less than 50 percent-by-weight may cause reduction of powder properties such as heat resistance, flow characteristics, flocculation resistance and the like.

Examples of useful styrene-type monomers for producing the styrene-type copolymer include styrene, and derivatives thereof including α-methylstyrene, p-methylstyrene, p-chlorostyrene and the like. It is desirable that styrene be used.

Examples of comonomers useful for copolymerization with styrene-type monomers include alkyl acrylates, alkyl methacrylates, acrylonitrile, maleic acid, maleic acid ester, methacrylate, acrylic acid, vinyl chloride, vinyl benzoate, vinylmethyl ketone, vinylhexyl ketone, vinylmethyl ether, vinylethyl ether, vinylisobutyl ether and like vinyl monomers. It is desirable that the alkyl acrylates used have 1~17 carbon atoms in the alkyl group, and the alkyl methacrylates used have 1~17 carbon atoms in the alkyl group. It is further desirable that the alkyl acrylates, or alkyl methacrylates be used in combination with unsaturated carboxylic acids such as acrylic acid, methacrylic acid, and maleic acid.

The toner binder resin is desirably a mixture of a first styrene-type copolymer having a number average molecular weight of 2,000~20,000 and preferably 5,000~15,000, and a second styrene-type copolymer having a number average molecular weight of 5,000~500,000 and preferably 100,000~400,000. The first styrene-type copolymer is desirably used at a rate of 10~70 parts-by-weight, preferably 20~50 parts-by-weight and more preferably 30~50 parts-by-weight. The second styrene-type copolymer is desirably used at a rate of 30~90 parts-by-weight, preferably 50~80 parts-by-weight and more preferably 50~70 parts-by-weight. Thus, when a plurality of styrene-type copolymers having different number average molecular weights are used, superior results are obtained relative to offset resistance, coiling resistance, toner charge buildup, and toner strength by the high molecular weight constituents, and excellent fixing characteristics are obtained by the low molecular weight styrene-type copolymer constituents.

When the mixture content is such that it contains the high molecular weight styrene-type copolymer constituent more than the low molecular weight styrene-type copolymer constituent, the toner charge buildup becomes smoother and fewer ultra fine powder is produced when manufacturing the toner by pulverization.

Reduction of toner fixing characteristics can be suppressed even when the amount of the high molecular weight styrene-type copolymer constituent is plentiful by using a styrene-type copolymer having a number average molecular weight of 2,000~20,000 as a low molecular weight constituent.

The number average molecular weights of styrene-type copolymers can be calculated as a molecular weight at the position of peak in a molecular weight distribution chromatogram measured by gel permeation chromatography (GPC).

A styrene-type copolymer having an acid value of 1~15 KOHmg/g, and preferably 3~10 KOHmg/g, is used in consideration of the stabilization of toner charge.

The various styrene-type copolymers used in the binder resin described above can be manufactured by well known methods. For example, suspension polymerization, emulsion polymerization, solution polymerization, bulk polymerization and the like.

Adjustment of the molecular weight of the styrene-type copolymers can be achieved using well known molecular weight regulating agents such as, for example, mercaptans such as lauryl mercaptan, phenyl mercaptan, butyl mercaptan, dodecyl mercaptan and the like, and halogenated carbons such as carbon tetrachloride, carbon tetrabromide and the like.

Although the styrene-type copolymer may contain constituents which are insoluble in tetrahydrofuran (THF) by using crosslinking agents such as divinylbenzene and the like, it is preferable that it not contain THF-insoluble constituents.

Other common resins may be mixed with the styrene-type copolymers. For example, polyester resin, epoxy resin, silicone resin, polystyrene resin, polyamide resin, polyurethane resin, acrylic resin and the like may be mixed therewith. It is desirable that the amount of said additional resins does not exceed 30 percent-by-weight of the total resin.

The offset preventing agents used in combination with the styrene-type copolymer are polyethylene wax and polypropylene wax.

Usable polypropylene waxes have a softening point of 135°~155° C., so as to be consistent with desired heat resistance and offset resistance. When a wax having a softening point less than 135° C. is used, high temperature offset may occur, and toner heat resistance may be reduced. When a wax having a softening point greater than 155° C. is used, fixing strength may be reduced.

Usable polyethylene waxes have a softening point of 100°~150° C., and preferably 120°~150° C., so as to be consistent with desired toner particle characteristics and offset resistance. When a wax having a softening point lower than 100° C. is used, toner particle characteristics may be reduced, and when a wax having a softening point higher than 150° C. is used, high temperature offset may occur.

In the present invention, the softening point of polypropylene wax is a value obtained by a method stipulated in Japanese Industrial Standard JIS K2531-1960. Furthermore, the softening point of polyethylene wax is a value obtained by a method stipulated in Japanese Industrial Standard JIS K-2207.

The percentage of polypropylene wax (PP) to polyethylene wax (PE) expressed as a weight ratio is desirably 1:6~1:1 (PP:PE), preferably 1:3~1:1, and ideally 1:3~1:1.1. When the percentage of polyethylene was is excessive, heat resistance problems may arise, whereas smearing problems may be unresolved if the percentage is too low.

The total amount of included polypropylene wax and polyethylene wax relative to 100 parts binder resin is desirably 2~10 parts-by-weight, and preferably 2~5 parts-by-weight. When the total amount of said waxes is less than 2 parts-by-weight, the width of the toner non-offset range may be narrowed and offset may occur. When the total amount of waxes is greater than 10 parts-by-weight, toner particle characteristics and heat resistance may be reduced.

Various common types of colorants may be added to the toner, such as, for example, carbon black.

In addition to binder resins, colorants, and offset preventing agents, other additives such as, for example, charge controlling agents and magnetic powders and the like may be added as desired.

Toner may be manufactured by melting and kneading binder resin containing styrene-type copolymer, offset preventing agent comprising a mixture of polyethylene and polypropylene, colorant and desired additives as necessary, and pulverizing and classifying the obtained kneaded mixture. At this time, it may be convenient to coarsely pulverize the kneaded material in conjunction with the subsequent pulverization process to obtain a coarsely pulverized material having a mean particle size of 0.5~5 mm, then finely pulverizing the coarse material to obtain particles having a mean particle size of 10~19 μm.

In the pulverization and classification processes, said pulverization and classification is preferably accomplished by pulverizer and classifier devices provided with a high-speed rotation rotor and having a function for imparting a mechanical impact force. This mechanical impact force is a physical impact force produce by contact of the particles with the high-speed rotation rotor provided in the pulverizer and classifier devices. Use of such pulverizer and classifier devices prevents production of ultra fine powder, stabilizes toner charging characteristics, and improves flow characteristics.

Specifically, the mechanical impact force may be achieved by impact pulverization methods, and preferably by high-speed airflow impact pulverization methods. Similar effect can be achieved using a vortex airflow generated between a rotor and an exterior liner via high speed rotation of the rotor. Although it is possible to accomplish the impact force by jet pulverization using an ultra high-speed airflow from a jet nozzle, power costs are markedly higher than impact pulvurization methods. Efficient particle formation can be particularly achieved by high-speed airflow impact pulverization.

Although commonly used impact type pulverizers may be used as a pulverizer suitable for imparting mechanical impact force, Criptron system (Kawasaki Heavy Industries, Ltd.) utilizing a high-speed airflow impact pulverization method is particularly desirable.

The construction of the criptron system is briefly shown in FIG. 1. The rotation unit comprises rotor 1 having multiple channels formed thereon, and the interior surface of the casing has stators mounted thereon which have multiple channels. A strong vortex and pressure oscillation are generated within the device by high-speed rotation of rotor 1. Raw materials are supplied into a pulverization chamber by an atmospheric airflow via intake port 3. Pulverization occurs via the strong airflow vortex, and particles rise in rotation with the rotor, and are discharged with air via exhaust port 4.

The ultra fine powder mixed with the raw materials and ultra fine powder produced during pulverization can be incorporated and fixed to the surface of the pulverized particles via the mechanical impact force at the same time the raw material is pulverized using the above-mentioned device.

Pulverized particles obtained in this manner has a very slight percentage of ultra fine powder content among the particles.

When the pulverized particles obtained in the manner described above are pulverized to small size particles (mean particle size: 5~10 μm), the jet airflow type pulverization method may be used. Jet airflow pulverization methods accelerate particles via a high-speed airflow so as to strike an impact plate, or pulverize particles by causing the particles to strike on another.

Conventional jet airflow type pulverizers may be used as the jet airflow pulverizing device. Such conventional devices include, for example, the jet pulverizer (Jet Mill model I; Japan Pneumatic Industries, Ltd.), and the counter jet mill (Hosokawa Micron, Ltd.) and the like.

Finally, the obtained fine particles are classified. It is desirable that classification also be accomplished using a classifying device utilizing a mechanical impact force; a rotor type classification unit may be used. The classification process smoothes the surface of the particles via the action of the impact force imparted by the rotor so as to produce spherical particles. Furthermore, free ultra fine powder is reduced because the ultra fine powder is strongly adhered to and embedded in the surface of the toner particles, thereby improving dispersion efficiency via the impact force of the classifying rotor, preventing mixing of ultra fine powder in the final toner product, and preventing the presence of free charge controlling agent by the same principles. Similar effects are not accomplished by conventional air classification devices which use the relative weight of particles for classification.

Figure 2:
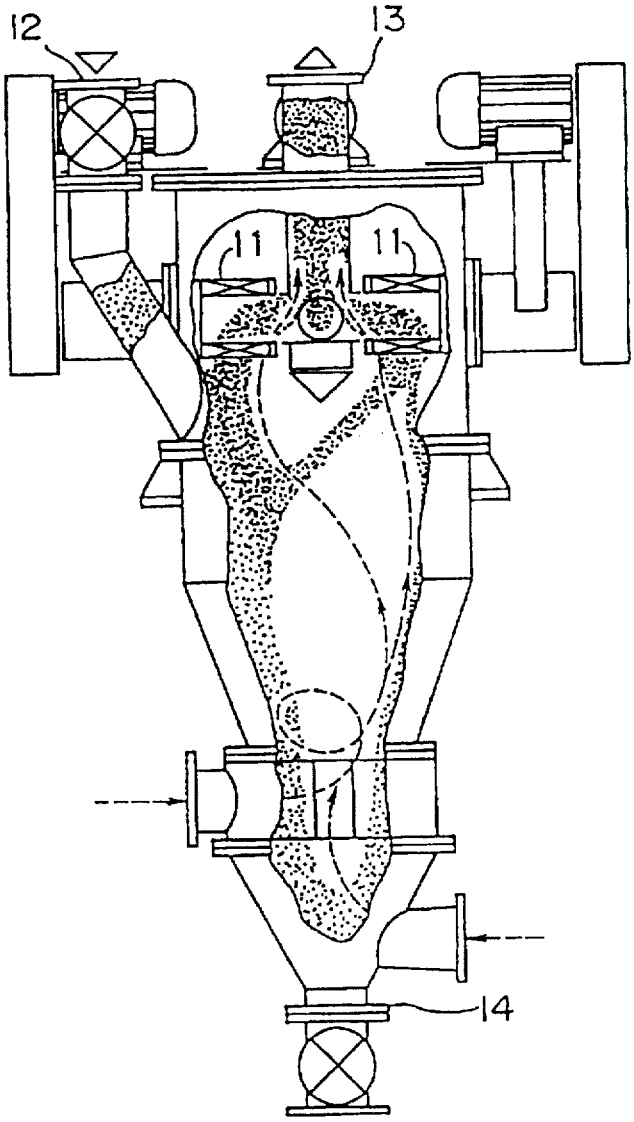
FIG. 2 shows an example of a classification device provided with a classification rotor as viewed in vertical center cross section.
Figure 3:
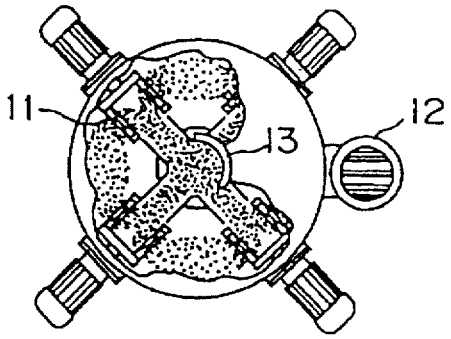
FIG. 3 shows a horizontal section view of the classification portion of the classification device of FIG. 2.

Desirable models of rotor type classification devices include various known types of devices, for example, Turbo Classifier (Nisshin Engineering Ltd.), Accucut (Japan Donaldson, Ltd.). Among such devices, the T-plex Fine Powder Classifier 100~1,000 ATP Series (Hosokawa Micron, Ltd.) is desirable. From this series of devices, the construction of the T-plex Multiwheel classifier is briefly shown in FIGS. 2 and 3. FIG. 2 is a center vertical section view, and FIG. 3 is a horizontal section view of the classifying unit.

Raw materials (small particles) are loaded from material loading port 12, and carried into a classifying chamber together with intake air or through a rotary valve. Intake air flows within the device, for example, from bottom to top as indicated by the arrow. Raw materials rises in accordance with the airflow, and enters classifying unit 11 for classification, and fine powder is removed through common discharge port 13. Classifying unit 11 has a plurality of individual classifying rotors mounted horizontally and are individually driven. A common speed controller controls the speeds of said rotors through a single frequency converter. The removed fine powder classified material is eliminated from discharge port 14. The raw material comprising small size particles may be air classified prior to being supplied to the rotor type classification device.

The above-mentioned toner is suitable for use as a positive charging toner, because styrene-type copolymer is used as the previously mentioned binder resin. For example, use of polyester resin as the binder resin is undesirable because the polyester resin itself essentially has negative charging characteristics which prevent suitable positive charging. It is also desirable to use a positive charging toner which contains a positive charge controlling agent such as nigrosine dyes, imidazole compounds and the like; the amount of such additive is preferably 2~7 percent-by-weight relative to the toner. It is further desirable to add 0.1~1.5 percent-by-weight of quaternary ammonium salt with the aforesaid positive charge controlling agent to stabilize the amount of toner charge.

A slight amount of magnetic powder may be added to the toner at a rate of 0.5~10 percent-by-weight to prevent toner dispersion.

Hydrophobic silica, hydrophobic titania, or hydrophobic alumina or like fluidizing agent may be added to the toner at a rate of 0.05~1.5 percent by-weight relative to the toner. Furthermore, fine resin particles of fluororesin such as tetrafluoroethylene polymer, acrylic resin or the like may be added to prevent Wear of the cleaning blade.

The present invention is applicable to various types of toners, e.g., two-component toners, monocomponent toners, magnetic toners and the like, which are manufactured by pulverization and classification.

Specific experimental examples of the toner of the present invention are described hereinafter.

EXAMPLE 1

| (pbw = parts-by-weight) | | |
|---|---|---|
| * | Thermoplastic styrene-acrylic resin [Containing 35 pbw styrene-butylacrylate-butylmethacrylate-methacrylic acid copolymer having a number average molecular weight of 5,000 determined by gel permeation chromatography (GPC) (monomer weight ratios = 7:1.4:1.4:0.2; acid value: 6.5 KOH mg/g) and 65 pbw styrene-butylacrylate-butylmethacrylate-methacrylic acid copolymer having a number average molecular weight of 200,000 measured by GPC (monomer weight ratio = 6:1.9:1.9:0.2; acid value: 6.5 KOH mg/g)] | 100 pbw |
| * | Polypropylene wax (Biscol 660P; Sanyo Chemical Industries, Ltd., softening point about 145° C.) | 1.0 pbw |
| * | Polyethylene wax (High Wax 200P; Mitsui Sekiyu Kagaku K.K., softening point about 120° C.) | 2.0 pbw |
| * | Carbon black (Mogal L; Cabot, Inc.) | 10 pbw |

-continued

| (pbw = parts-by-weight) | |
|---|---|
| * Nigrosine dye (Nigrosine Base EX; Oriental Chemicals, Inc.) | 5.0 pbw |
| * Quaternary Ammonium Salt (P-53; Orient Chemical, Inc.) | 0.5 pbw |
| * Magnetic powder (Zinc ferrite) | 2 pbw |

The above-mentioned materials were loaded in a Henschel mixer (9 liter capacity) and mixed for 3 minutes at 3,000 rpm. The mixture was then kneaded by continuous extrusion kneader model PCM 30 (1/d=32.5).

After the kneaded material cooled, it was coarsely pulverized by a feather mill (2 mm mesh). The coarsely pulverized material was then finely pulverized to a particle size of 11 μm by a mechanical pulverizer (Model Criptron KTM-0; Kawasaki Heavy Industries, Ltd.), coarse particles were separated by a natural airflow type classifier (DS classifier; Japan Pneumatic, Ltd.), and finally fine particles were separated by a mechanical classifier (50ATP Classifier; Hosokawa Micron, Ltd.) to obtain a toner having a mean particle size of 11 μm.

To the obtained toner were added 0.15 percent-by-weight hydrophobic silica (R-974; Nippon Aerosil Ltd.) 0.03 percent-by-weight teflon beads (Central Glass, Ltd.).

EXAMPLE 2

A toner was produced in the same manner as described in Example 1 with the exception that 100 pbw of the thermoplastic styrene acrylic resin used comprised 60 pbw styrene-butylacrylate-butylmethacrylate-methacrylic acid copolymer having a number average molecular weight of 5,000 measured by GPC (monomer weight ratios=7:1.4:1.4:0.2; acid value: 6.5 KOHmg/g) and 40 pbw of styrene-butylacrylate-butylmethacrylate-methacrylic acid copolymer having a number average molecular weight of 200,000 measured by GPC (monomer weight ratios=6:1.9:1.9:0.2; acid value: 6.5 KOHmg/g), with only 3.0 pbw polypropylene wax (softening point about 145° C.; Biscol 660P; Sanyo Chemicals Ltd.) added as an offset preventing agent.

EXAMPLE 3

A toner was produced in the same manner as described in Example 1 with the exception that 100 pbw of the thermoplastic styrene acrylic resin used comprised 47 pbw styrene-butylacrylate-methacrylic acid copolymer having a number average molecular weight of 15,000 measured by GPC (monomer weight ratios=7:2.8:0.2; acid value: 6.5 KOHmg/g) and 53 pbw of styrene-butylacrylate-methacrylic acid copolymer having a number average molecular weight of 350,000 measured by GPC (monomer weight ratios= 6:3.8:0.2; acid value: 6.5 KOHmg/g).

EXAMPLE 4

A toner was produced in the same manner as described in Example 1 with the exception that 100 pbw of the thermoplastic styrene acrylic resin used comprised 60 pbw styrene-butylacrylate-methacrylic acid copolymer having a number average molecular weight of 15,000 measured by GPC (monomer weight ratios=7:2.8:0.2; acid value: 6.5 KOHmg/g) and 40 pbw of styrene-butylacrylate-methacrylic acid copolymer having a number average molecular weight of 350,000 measured by GPC (monomer weight ratios= 6:3.8:0.2; acid value: 6.5 KOHmg/g), with only 3.5 pbw polyethylene wax (softening point about 120° C.; High Wax 200P; Mitsui Sekiyu Kagaku K.K.) added as an offset preventing agent.

EXAMPLE 5

A toner was produced in the same manner as described in Example 1 with the exception that 1.5 pbw polypropylene wax (Biscol 550P; Sanyo Chemicals, Ltd., softening point about 151° C.) and 2.0 pbw polyethylene wax (High Wax 200P; Mitsui Sekiyu Kagaku K.K., softening point about 120° C.) were used as offset preventing agents.

EXAMPLE 6

A toner was produced in the same manner as described in Example 1 with the exception that 1.0 pbw polypropylene wax (Biscol 660P; Sanyo Chemicals, Ltd., softening point about 145° C.) and 2.5 pbw polyethylene wax (High Wax 800P; Mitsui Sekiyu Kagaku K.K., softening point about 146° C.) were used as offset preventing agents.

EXAMPLE 7

A toner was produced in the same manner as described in Example 1 with the exception that 2.0 pbw polypropylene wax (Biscol 550P; Sanyo Chemicals, Ltd., softening point about 151° C.) and 2.5 pbw polyethylene wax (High Wax 800P; Mitsui Sekiyu Kagaku K.K., softening point about 146° C.) were used as offset preventing agents.

EXAMPLE 8

A toner was produced in the same manner as described in Example 2 with the exception that a jet airflow type pulverizer (Model IDS-2 Jet Mill Pulverizer; Japan Pneumatic, Ltd.) and classifier (Model DS Classifier; Japan Pneumatic, Ltd.) were used instead of the mechanical pulverizer and mechanical classifier of Example 2.

EXAMPLE 9

A toner was produced in the same manner as described in Example 1 with the exception that 1.5 pbw polypropylene wax (Biscol 660P; Sanyo Chemicals, Ltd., softening point about 145° C.) and 2.5 pbw polyethylene wax (High Wax 171P; Mitsui Sekiyu Kagaku K.K., softening point about 107° C.) were used as offset preventing agents.

EXAMPLE 10

A toner was produced in the same manner as described in Example 1 with the exception that 2.0 pbw polypropylene wax (Biscol 550P; Sanyo Chemicals, Ltd., softening point about 151° C.) and 1.0 pbw polyethylene wax (High Wax 200P; Mitsui Sekiyu Kagaku K.K., softening point about 120° C.) were used as offset preventing agents.

EXAMPLE 11

A toner was produced in the same manner as described in Example 1 with the exception that 100 pbw of thermoplastic polyester resin (acid value: 8 KOHmg/g; OH value: 40 KOHmg/g; Tm: 136° C.; Tg: 64° C.) was used as binder resin.

EXAMPLE 12

A toner was produced in the same manner as described in Example 1 with the exception that 0.5 pbw polypropylene wax (Biscol 550P; Sanyo Chemicals, Ltd., softening point about 151° C.) and 2.5 pbw polyethylene wax (High Wax 200P; Mitsui Sekiyu Kagaku K.K., softening point about 120° C.) were used as offset preventing agents.

EXAMPLE 13

A toner was produced in the same manner as described in Example 1 with the exception that a jet airflow type pulverizer (Jet Mill model IDS-II; Japan Pneumatic, Ltd.) and classifier (model DS Classifier; Japan Pneumatic, Ltd.) were used instead of the mechanical pulverizer and mechanical classifier of Example 1.

EVALUATIONS

Each of the toners obtained by above-mentioned procedure was evaluated for the following criteria.

Smear Resistance

Using a copying machine (Model EP9765; Minolta Co., Ltd.), the toners were fixed to copy sheets, and subsequently the copy sheet on which a copy image was formed was rubbed against a separate new and unused copy sheet. The degree of soiling on the new unused copy sheet was observed, and ranked as shown below.

○: No soiling
Δ: Slight soiling observed, but no practical problem
X: Soiling of entire paper surface

Manufacturing Properties

Manufacturing properties were evaluated by calculating the direct yield of pulverization and classification processes, and ranking the results as shown below.

○: Yield of 80% or higher
Δ: Yield of 70% or higher, but less than 80%
X: Yield less than 70%

Toner Scattering Within the Copying Machine

A copying machine (model EP9765; Minolta Co., Ltd.) was used to make 50,000 copies. Toner dispersion within the copying machine and toner spills from the developing devices were observed, and ranked as described below.

○: No practical problem
Δ: No problem for 10,000 copies, but required maintenance after 50,000 copies
X: Toner dispersion around the developing unit

Fog

When toner scattering within the copying machine was evaluated, toner fog in the copy images after 50,000 copies was examined, and ranked as described below.

○: No fog observed
Δ: Slight fogging, but not a practical problem
X: Extensive toner fog

Heat Resistance

Five grams of toner were loaded in an incubator and stored for 24 hr at 50° C., then the measuring container was inverted and the toner allowed to spill out. The results were ranked as described below.

○: Toner spilled out directly after inverting the container
Δ: Toner spilled out after a little while when the container was inverted
X: Toner did not spill out of the inverted container

Offset Resistance

The fixing roller temperature was elevated to near 250° C., and offset was ranked by temperature as described below.

○: No offset even at 250° C.
Δ: Offset above 230° but below 250° C.
X: Offset below 230° C.

TABLE 1

| Toner | Smear Resistance | Mfr Properties | Scattering in Copier | Fog | Heat Resistance | Offset Resistance |
|---|---|---|---|---|---|---|
| Ex. 1 | Δ | ○ | ○ | ○ | Δ | ○ |
| Ex. 2 | X | ○ | X | X | ○ | ○ |
| Ex. 3 | Δ | ○ | ○ | ○ | Δ | ○ |
| Ex. 4 | ○ | X | Δ | Δ | X | X |
| Ex. 5 | Δ | ○ | ○ | ○ | Δ | Δ |
| Ex. 6 | Δ | ○ | ○ | ○ | ○ | Δ |
| Ex. 7 | ○ | Δ | Δ | Δ | ○ | Δ |
| Ex. 8 | X | X | X | X | Δ | ○ |
| Ex. 9 | Δ | X | Δ | Δ | X | Δ |
| Ex. 10 | X | ○ | ○ | ○ | ○ | Δ |
| Ex. 11 | ○ | X | X | X | X | ○ |
| Ex. 12 | ○ | ○ | Δ | ○ | Δ | Δ |
| Ex. 13 | Δ | ○ | X | X | Δ | ○ |

Although the present invention has been fully described by way of examples with reference to the accompanying drawings, it is to be noted that various changes and modifications will be apparent to those skilled in the art.

Therefore, unless otherwise such changes and modification depart from the scope of the present invention, they should be construed as being included therein.

What is claimed is:

1. A toner for developing an electrostatic latent image comprising:

a binder resin comprising a first copolymer having a number average molecular weight of 2,000 to 20,000 and a second copolymer having a number average molecular weight of 50,000 to 500,000, wherein a total amount of said first and said second copolymer is 70 percent by weight or more on a basis of the binder resin, said first and said second copolymer respectively comprising styrene copolymer or styrene derivative copolymer;

a colorant; and an offset preventing agent comprising a polypropylene having a softening point of 135° C. to 155° C. and a polyethylene having a softening point of 100° C. to 150° C., wherein a total amount of said polypropylene and said polyethylene is 2 to 10 parts by weight per 100 parts by weight of the binder resin and a weight ratio of said polypropylene to said polyethylene is 1:6 to 1:1.

2. The toner as claimed in claim 1 wherein the weight ratio of the polypropylene to the polyethylene is 1:3 to 1:1.

3. The toner as claimed in claim 1 wherein the softening point of the polypropylene is higher than the softening point of the polyethylene.

4. The toner as claimed in claim 1 wherein the amount of said offset preventing agent is in the range of 2 to 5 parts by weight per 100 parts by weight of the binder resin.

5. The toner as claimed in claim 1 which further comprises a charge controlling agent.

6. The toner as claimed in claim 5 wherein said charge controlling agent is at least one compound selected from the group consisting of nigrosine dyes and imidazole compounds.

7. The toner as claimed in claim 6 wherein said charge controlling agent is contained in an amount of 2 to 7 percent by weight on the basis of the toner.

8. The toner as claimed in claim 6 which further comprises a quaternary ammonium salt.

9. The toner as claimed in claim 8 wherein said quaternary ammonium salt is contained in an amount of 0.1 to 1.5 percent by weight on the basis of the toner.

10. The toner as claimed in claim 1 which further comprises a magnetic powder, said magnetic powder contained in an amount of 0.5 to 10 percent by weight on the basis of the toner.

11. The toner as claimed in claim 1 which further comprises at least one fluidizing agent selected from the group consisting of hydrophobic silica, hydrophobic titania and hydrophobic alumina, said fluidizing agent externally added to the toner.

12. The toner as claimed in claim 11 which further comprises a fine resin particle made of a compound selected from the group consisting of fluororesins and acrylic resins, said fine resin particle externally added to the toner together with the fluidizing agent.

13. The toner as claimed in claim 1 wherein said first copolymer is contained in an amount of 10 to 70 parts by weight per 100 parts by weight of the binder resin.

14. The toner as claimed in claim 13 wherein the amount of said first copolymer is 20 to 50 parts by weight per 100 parts by weight of the binder resin.

15. A toner for developing an electrostatic latent image comprising:

a binder resin comprising a copolymer having peaks in a molecular weight distribution chromatogram measured by gel permeation chromatography, wherein a first peak is in a range of 2,000 to 20,000 and a second peak is in a range of 50,000 to 500,000 and a total amount of said copolymer is 70 percent by weight or more on the basis of the binder resin, said copolymer comprising styrene copolymer or styrene derivative copolymer;

a colorant; and an offset preventing agent comprising a polypropylene having a softening point of 135° C. to 155° C. and a polyethylene having a softening point of 100° C. to 150° C., wherein a total amount of said polypropylene and said polyethylene is 2 to 10 parts by weight per 100 parts by weight of the binder resin.

16. The toner as claimed in claim 15 wherein said copolymer is synthesized with at least one monomer selected from the group consisting of a styrene monomer and a styrene derivative monomer and a comonomer, wherein said monomer is contained in an amount of 50 percent by weight on the basis of a total amount of said monomer and comonomer.

17. The toner as claimed in claim 16 wherein said monomer is at least one compound selected from the group consisting of a styrene, α-methylstyrene, p-methylstyrene and p-chlorostyrene.

18. The toner as claimed in claim 16 wherein said comonomer is at least one compound selected from the group consisting of unsaturated carboxylic acid, alkyl acrylates having 1 to 17 carbon atoms in their alkyl group and alkyl methacrylates having 1 to 17 carbon atoms in their alkyl group.

19. The toner as claimed in claim 15 which contains the polypropylene less than the polyethylene.

20. The toner as claimed in claim 19 which has a weight ratio of the polypropylene to the polyethylene in the range of 1:3 to 1:1.1.

21. The toner as claimed in claim 18 wherein said copolymer has an acid value of 1 to 15 KOHmg/g.

22. The toner as claimed in claim 21 wherein the acid value of the copolymer is 3 to 10 KOHmg/g.

23. The toner as claimed in claim 15 wherein said first peak is in the range of 3,000 to 18,000 and said second peak is in the range of 80,000 to 500,000.

24. A toner for developing an electrostatic latent image, wherein said toner is produced by a process comprising steps of:

melting and kneading a mixture comprising a binder resin, a colorant and an offset preventing agent, said binder resin comprising copolymer having peaks in a molecular weight distribution chromatogram measured by gel permeation chromatography, wherein a first peak is in a range of 2,000 to 20,000 and a second peak is in a range of 50,000 to 500,000, said copolymer comprising styrene copolymer or styrene derivative copolymer, and said offset preventing agent comprising a polypropylene having a softening point of 135° C. to 155° C. and a polyethylene having a softening point of 100° C. to 150° C., wherein a total amount of said polypropylene and said polyethylene is 2 to 10 parts by weight per 100 parts by weight of the binder resin;

cooling the melted and kneaded mixture;

first, pulverizing the cooled mixture into a coarse pulverized mixture;

second, pulverizing the coarse pulverized mixture into a finely pulverized mixture by passing the coarse pulverized mixture through a zone under dispersed conditions in a flowing air stream, said zone being formed between a rotating member and a fixed member; and classifying the finely pulverized mixture to obtain the toner.

25. The toner as claimed in claim 24 wherein said copolymer comprises a first copolymer having a peak of the molecular weight distribution in a range of 2,000 to 20,000 and a second copolymer having a peak of the molecular weight distribution in a range of 50,000 to 500,000, said first copolymer contained in an amount of 20 to 50 parts by weight per 100 parts by weight of the binder resin.

26. The toner as claimed in claim 24 wherein said copolymer has an acid value of 1 to 15 KOHmg/g.

27. The toner as claimed in claim 24 wherein said pulverizer has a rotating member for pulverization and carries out the pulverization by the impact of said rotating member against the toner.

28. A toner for developing an electrostatic latent image comprising:

a binder resin comprising a first polymer and a second polymer having a number average molecular weight greater than that of said first polymer, said first and said second polymer respectively comprising styrene polymer or styrene derivative polymer, said first polymer having a number average molecular weight of 2,000 to 20,000 and said second polymer having a number average molecular weight of 50,000 to 500,000;

a colorant; and an offset preventing agent comprising a polypropylene having a softening point of 135° C. to 155° C. and a polyethylene having a softening point of 100° C. to 150° C.

29. The toner as claimed in claim 28 wherein said first and second polymer are copolymer synthesized with at least one monomer selected from the group consisting of a styrene monomer and a styrene derivative monomer and a comonomer.

30. The toner as claimed in claim 29 wherein a total amount of said first and second copolymer is 70 percent by weight or more on the basis of the binder resin.

31. The toner as claimed in claim 28 wherein a total amount of said polypropylene and said polyethylene is in the range of 2 to 10 parts by weight per 100 parts by weight of the binder resin.

32. The toner as claimed in claim 28 wherein a weight ratio of said polypropylene to said polyethylene is in the range of 1:6 to 1:1.

33. A toner for developing an electrostatic latent image comprising:

a binder resin comprising a first copolymer having a number avenge molecular weight of 2,000 to 20,000 and a second copolymer having a number average molecular weight of 50,000 to 500,000, wherein a total amount of said first and second copolymer is 70 percent by weight or more on the basis of the binder resin, said first and said second copolymer respectively comprising styrene copolymer or styrene derivative copolymer;

a black colorant; and an offset preventing agent comprising a polypropylene having a softening point of 135° C. to 155° C. and a polyethylene having a softening point of 100° C. to 150° C., wherein a total amount of said polypropylene and said polyethylene is 2 to 10 parts by weight per 100 parts by weight of the binder resin and a weight ratio of said polypropylene to said polyethylene is 1:6 to 1:1.

34. The toner as claimed in claim 33, wherein said black colorant comprises carbon black.

35. A toner for developing an electrostatic latent image comprising:

a binder resin comprising at fist polymer and a second polymer having a number average molecular weight greater than that of said first polymer, said first and said second polymer respectively comprising styrene polymer or styrene derivative polymer said first polymer having a number average molecular weight of 2,000 to 20,000 and said second polymer having a number average molecular weight of 50,000 to 500,000;

a colorant; and an offset preventing agent comprising a polypropylene having a softening point of 135° C. to 155° C. and a polyethylene having a softening point of 100° C. to 150° C., an amount of said polypropylene being less than that of said polyethylene.

* * * * *

UNITED STATES PATENT AND TRADEMARK OFFICE

CERTIFICATE OF CORRECTION

PATENT NO. : 5,712,071

DATED : January 27, 1998

INVENTOR(S) : Yoshihiro MIKURIYA et al.

It is certified that error appears in the above-identified patent and that said Letters Patent is hereby corrected as shown below:

Claim 33, line 9 delete "avenge" and insert --average--.

Claim 35, line 7 delete "at fist" and insert --a first--.

Signed and Sealed this

Fifteenth Day of September, 1998

*Attest:*

*Attesting Officer*

Bruce Lehman

BRUCE LEHMAN

*Commissioner of Patents and Trademarks*